US008616410B2

(12) United States Patent
Ansaloni et al.

(10) Patent No.: US 8,616,410 B2
(45) Date of Patent: Dec. 31, 2013

(54) APPARATUS FOR DOSING POWDERY OR GRANULATED MATERIALS IN CAPSULES OR THE LIKE

(75) Inventors: Angelo Ansaloni, Crespellano (IT); Ernesto Gamberini, Rastignano (IT); Antonio Tagliavini, Bologna (IT)

(73) Assignee: MG2—S.r.l., Pianoro (IT)

( * ) Notice: Subject to any disclaimer, the term of this patent is extended or adjusted under 35 U.S.C. 154(b) by 1112 days.

(21) Appl. No.: 12/566,849

(22) Filed: Sep. 25, 2009

(65) Prior Publication Data

US 2010/0078093 A1 Apr. 1, 2010

(30) Foreign Application Priority Data

Sep. 30, 2008 (IT) ..... BO2008A0598

(51) Int. Cl.

| | |
|---|---|
| ***B67D 1/00*** | (2006.01) |
| ***B67D 7/14*** | (2010.01) |
| ***A45D 24/22*** | (2006.01) |
| ***B65D 83/00*** | (2006.01) |
| ***B65D 88/66*** | (2006.01) |
| ***B65B 1/34*** | (2006.01) |
| ***B65B 3/26*** | (2006.01) |
| ***B65B 1/30*** | (2006.01) |

(52) U.S. Cl.

USPC ..... 222/56; 222/64; 222/196; 141/128; 141/83

(58) Field of Classification Search

USPC ..... 222/196, 197, 55, 56, 77, 63; 141/128; 177/60; 193/32

See application file for complete search history.

(56) References Cited

U.S. PATENT DOCUMENTS

| | | | | | |
|---|---|---|---|---|---|
| 1,416,073 | A | * | 5/1922 | Steinbach | 193/32 |
| 2,792,030 | A | * | 5/1957 | Wahl | 141/145 |
| 3,091,368 | A | * | 5/1963 | Harley et al. | 222/56 |
| 3,972,449 | A | * | 8/1976 | Smith | 222/64 |
| 4,572,782 | A | * | 2/1986 | Smith et al. | 209/236 |
| RE32,101 | E | * | 4/1986 | Ricciardi et al. | 222/56 |
| 4,821,782 | A | * | 4/1989 | Hyer | 141/83 |
| 5,236,021 | A | | 8/1993 | Bewlay et al. | |
| 5,568,022 | A | * | 10/1996 | Tranovich | 318/566 |
| 5,657,902 | A | * | 8/1997 | Kraus | 222/56 |

(Continued)

FOREIGN PATENT DOCUMENTS

| | | |
|---|---|---|
| GB | 1455920 | 11/1976 |
| JP | 2003-123016 | 5/2003 |

(Continued)

OTHER PUBLICATIONS

Chinese Office Action dated Mar. 1, 2013.

(Continued)

*Primary Examiner* — Paul R Durand
*Assistant Examiner* — Benjamin R Shaw
(74) *Attorney, Agent, or Firm* — Gottlieb, Rackman & Reisman, P.C.

(57) ABSTRACT

Apparatus for dosing powdery or granulated materials in capsules, or the like. The apparatus comprises an engine associated with a transducer controlling chuting means. The engine imparts to the chuting means movements which are proportional to an electric signal controlled by an electronic control unit. The movements of the chuting means, together with the regulation of the spatial position assumed by the chuting means, are such to accurately dose the powdery or granulated material in the bases of the capsules.

13 Claims, 3 Drawing Sheets

(56) References Cited

U.S. PATENT DOCUMENTS

| | | | | |
|---|---|---|---|---|
| 6,182,712 | B1 * | 2/2001 | Stout et al. | 141/18 |
| 6,257,447 | B1 * | 7/2001 | Schlienger et al. | 222/55 |
| 7,090,200 | B2 * | 8/2006 | Morse et al. | 254/332 |
| 7,878,366 | B2 | 2/2011 | Cicognani | |
| 2004/0003866 | A1 | 1/2004 | Rocchio et al. | |
| 2005/0217752 | A1 | 10/2005 | Facchini | |
| 2007/0151623 | A1 * | 7/2007 | Poole et al. | 141/83 |

FOREIGN PATENT DOCUMENTS

| | | |
|---|---|---|
| JP | 2004-167550 | 6/2004 |
| JP | 2005 272085 | 10/2005 |
| JP | 2008504178 | 2/2008 |
| JP | 2008-514257 | 5/2008 |
| WO | WO 2006 003377 | 1/2006 |
| WO | WO 2008 095521 | 8/2008 |

OTHER PUBLICATIONS

First Japanese Office Action issued for corresponding application JP 2009-225992—mailing date: Sep. 17, 2013.

* cited by examiner

APPARATUS FOR DOSING POWDERY OR GRANULATED MATERIALS IN CAPSULES OR THE LIKE

The present invention concerns an apparatus for accurately and rapidly dosing powdery or granulated materials, in particular for filling capsules in the pharmaceutical field.

The apparatus object of the present invention allows an accurate and rapid dosing of amounts of powdery or granulated material which can approximately vary from 0.5 mg to 100 mg.

BACKGROUND OF THE INVENTION

As known, there is an increasing need to accurately dose small amounts of powdery or granulated drugs, thus limiting waste. A further need is dosing and filling the base of the capsule as rapidly as possible, in an automated way and without the operator coming into contact with the product.

The aforesaid needs are due to different and often concurrent causes, for instance the exorbitantly high cost of some drugs, the pharmaceutical tendency to the so-called "low dosage", which reduces the amount of excipient, and the appearance of difficult-to-treat powders because of their fineness, their scarce flowability, their tendency to clot and/or because they must be extremely delicately treated from a mechanical point of view.

To this regard, the case of powdery inhalable medicines, which are difficult to dose because of their volatility and because their texture must not be altered during the dosing, for instance by means of mechanical stress, is highly revealing.

One of the most diffused methods involves the use of a sieve.

The equipments made according to this method are based on the known, everyday fact that, in a sieve filled with a powdery material, natural "bridges" tend to form in correspondence to the holes. By applying no stress, the sieve reaches a state of balance, wherein all holes are blocked and the material does not flow through them. By applying stress on the sieve, some of these bridges break down and the material flows through the holes until the surrounding conditions allow again said state of balance.

Both the amount of material passing through each hole of the sieve before the conditions for a new hole blockage occur and the percentage of holes opened up according to a certain kind of stress follow probabilistic laws. The dependence of the flow of material on the applied stress can be used for the dosage, but the regularity of this behaviour is generally directly proportional to the number of holes.

The relationship existing between the characteristics of the material and the size of the holes is even intuitively clear. In fact, with holes above a certain size the material passes completely through them without stress, whereas with holes below a certain size the powdery material does not pass at all, even if stress is applied.

Therefore, there is an optimal dosage size of the holes of the sieve, optimal size depending on the material and its conditions (e.g. granulometry, moisture, etc.). Furthermore, the size of the holes of the sieve is selected so that the material does not pass in the absence of vibrations, whereas it passes with the desired flow in the presence of stress. The adjustment of the size of the holes to the material is a critical point, since even modest variations in the material's characteristics can lead on the one hand to the blockage of the holes and on the other hand to mistakes due to an excessive flow.

The number of holes should be high to obtain a sufficiently regular behaviour and a larger flow in the starting phase for a quicker filling of the capsules. On the other hand, a huge number of holes, increasing the minimum amount of material released after the stress, lowers the resolution and therefore the accuracy in the achievement of the predetermined value.

The most evident problem of this technique is the clotting of the sieve, which compels a progressive increase of the intensity of stress until the amount of released material at the unblocking moment turns out to be excessive, thus involving a remarkable loss of time and a frequent rejection because of an erroneous dosage. However, also the obvious method of increasing the intensity of stress is often not enough to solve the problem; therefore, attempts have been made to adopt other solutions, such as an overturning of the container, the use of compound stresses or the insertion of decompacting devices.

Moreover, the situation is even more critical because of the clots present in the product to be dosed and, above all, because of the tendency of some kinds of material to form clots as a consequence of vibrations.

In brief, once defined certain operating conditions (kind of product, diameter and number of the holes, filling level of the sieve) the applied stress must be higher than a certain level to cause the unblocking and the subsequent fall of material. Once exceeded this threshold, the amount of falling material usually has a minimum value determining the obtainable resolution and therefore the chance that the final dosage falls within a certain tolerance range. The release of material highly depends on the number of applied stresses and less on their intensity.

SUMMARY OF THE INVENTION

Therefore, it is the object of the present invention to provide an apparatus which is free from the aforesaid disadvantages being, at the same time, easy and cheap to produce.

The present invention is based on the known principle of the chuting means for a gradual release of the powdery material.

Because of the mechanical stress applied on the chuting means, the powdery material they contain flows downwards till reaching the edge, wherefrom it falls for gravity into the assigned container (for instance, the base of a capsule for pharmaceutical applications).

Furthermore, in the present invention the inclination of the chuting means is adjusted according to the characteristics of the material in order to obtain a suitable flow under the effect of stress, but above all in order to obtain an instantaneous arrest of the flow in the absence of stress.

The stress causes the material, loaded in the back part of the chuting means by a feeding device, to advance towards the far edge of the chuting means, thus forming a thin layer.

Moreover, the far edge of the chuting means has such a width to form quite a broad falling "front" if compared to the size of the particles of the material. In this way, for statistical reasons, the falling flow regularly and repeatably depends on the width, the frequency and the waveform of the applied stress.

The advantages of this solution are connected to its simplicity. For instance, since there are no obstacles or discontinuity, and since the material layer is very thin, the system does not suffer under clogging or compacting problems which are typical of other known systems.

BRIEF DESCRIPTION OF THE DRAWINGS

For a better understanding of the present invention it will now be described a preferred exemplificative and non limitative embodiment (with some variations) with a reference to the enclosed figures, in which.

DETAILED DESCRIPTION OF THE INVENTION

Figure 1:
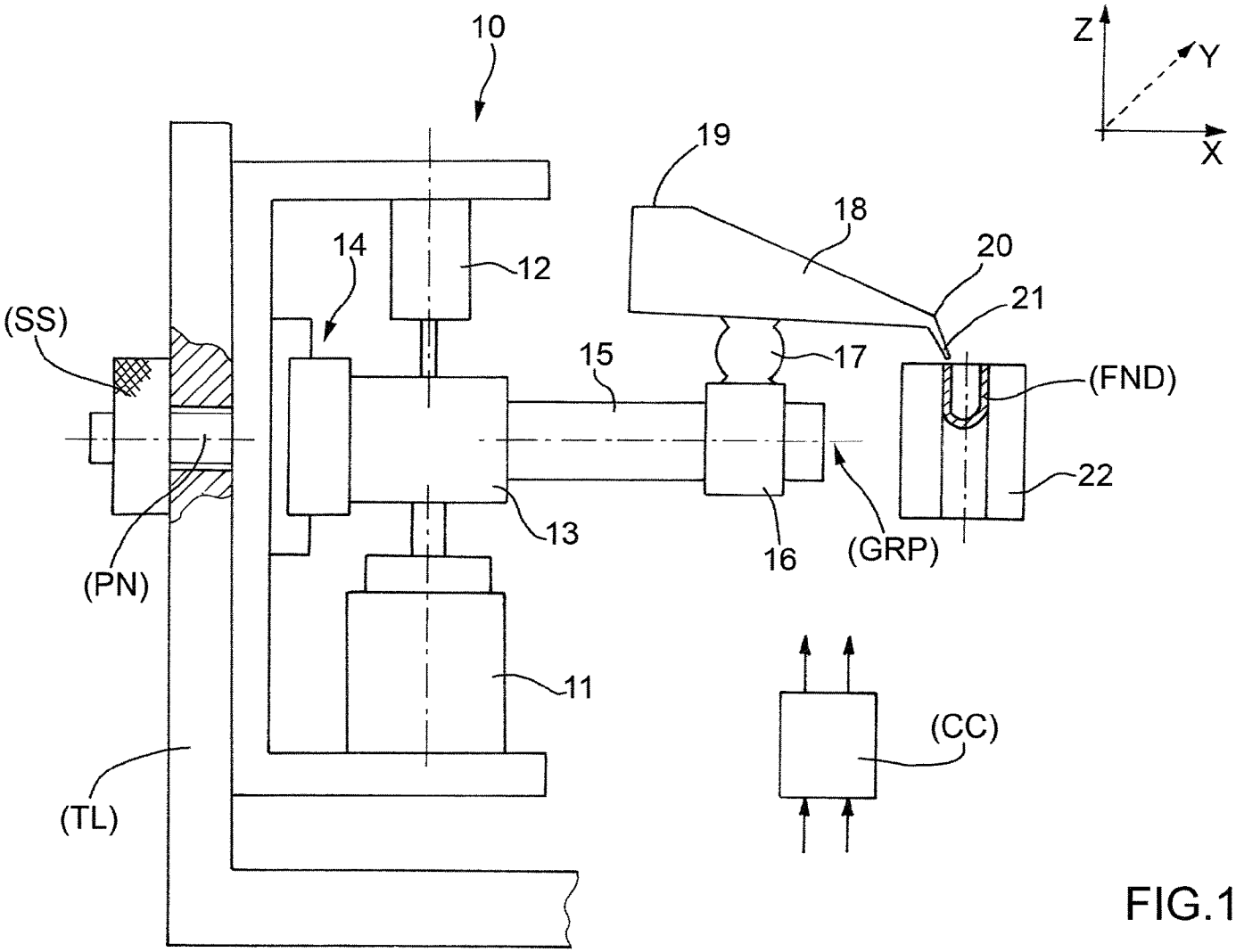
FIG. 1 schematically shows the object of the present invention, namely an apparatus for dosing powdery or granulated materials within capsules or similar containers.

In FIG. 1 the reference number 10 indicates as a whole an apparatus for dosing powdery or granulated materials in capsules or the like, the apparatus 10 being produced according to the present invention.

The apparatus 10 comprises an engine 11 (e.g. a linear "voice coil", or even different) associated with a transducer 12 (e.g. a differential transformer (LVDT), but also an inductive, potentiometric or optical kind), both oppositely mounted on a housing (TL).

As it will be better explained hereinafter, the apparatus 10 is controlled by an electronic control unit (CC) shown in more detail in FIG. 3.

By means of elements contained in said electronic control unit, the engine 11 and the transducer 12 are mutually connected in order to form a position servomechanism to impart to a moving element 13 controlled movements which are proportional to an electric signal opportunely generated by the electronic control unit (CC) (see below). The moving element 13 is supported by a sliding guide 14, and is provided with an arm 15 whereon a cursor 16 is fixed (by means of a "tie" fastening) together with a spherical articulated joint 17.

Paddle-shaped chuting means 18 are fastened on this spherical articulated joint 17.

Because of the acceleration following the movements imparted by the moving element 13, the inclination and the shape of the chuting means 18, the material loaded into the back part 19 of the chuting means 18 advances, having at the same time a tendency to form a thin and homogenous layer.

The powdery or granulated material reaching the front edge 20 of the chuting means 18 falls, led by a possible pilot element 21, inside a base (FND) of a capsule placed inside a measuring cell 22. The base (FND) is supported by means not represented in FIG. 1 (e.g. a lower pushing rod, or a suitable reduction of the section of the hole of the measuring cell 22).

Advantageously, but not necessarily, this cell 22 can be of a capacitive kind (e.g. according to patent application EP 1860409 of the same Applicant) and is therefore able to measure the mass of powdery or granulated material inside the base (FND) by means of the electronics associated with said transducer, but here represented inside the electronic control unit (CC), continuously, and with a negligible delay if compared to the progress of the dosing process.

The result of the mass measurement is registered by the electronic control unit (CC) which, by suitably varying the electric signal controlling the linear engine 11 and directly determining the flow of material sliding into the base (FND), can automatically regulate the process, thus following a predetermined progress of the flow in time (dosage profile) till rapidly and accurately reaching the desired dosage.

In other words, the apparatus 10, as it is, allows to control the flow (much more accurately than the known sieve systems) according to the amount to be dosed, and therefore allows to follow a pre-determined "dosage profile" (namely: quick release at the beginning, slow release at the end for a better accuracy of the dosage).

The axis of a group (GRP) comprising the linear engine 11, the transducer 12 and the moving element 13 can be inclined with regard to the vertical, to impart stress with even an horizontal component to the product, if needed.

In fact, the fastening of this group (GRP) to the housing (TL) substantially occurs by means of a pin (PN) provided with a suitable tightening element (SS). It is clear that if there is a rotation of the group (GRP) the chuting means 18 must be suitably re-oriented.

The pilot element 21 is shaped so that all the material entering the measuring cell 22 flows inside the base (FND) (for instance not stopping on its edge). If some material should stop on said pilot element 21, for example by adhering to its surface, it would not represent a problem, because it would be outside the measuring cell 22 and therefore it would not be measured.

Moreover, said pilot element 21 is sufficiently steep and vibrates together with the chuting means 18; this avoids accumulations of material inside the pilot element 21 which could cause an uneven dosage by means of their detachment.

As previously stated, the material to be dosed is loaded in the back part 19 of the chuting means 18 in such amounts to allow, especially in case of low dosage, the filling of a conspicuous number of capsule bases (FND).

It is clear that the system works well if the chuting means 18 are continuously fed. This is guaranteed by a feeding system (not shown) which can comprise a mobile arm and a vibrating metering device releasing a product so that it maintains a determined level in the back part 19 of the chuting means 18 with an approximately constant value, which can also be varied according to the material's characteristics.

This operation does not require high accuracy and can be carried out by means of conventional measures, for instance by means of a (capacitive, optical or ultrasonic) sensor (not shown) detecting the level of material. The chuting means 18 are regularly fed under the control of this sensor. The material is unloaded in the back part 19 of the chuting means 18, directly or on a metal net 23 possibly applied on them for keeping and/or crushing the originally formed clots.

A possibility offered by the present system, which is clear if the system is used with a vertical (or scarcely inclined) applied stress axis, consists in that the average current in the engine 11 is proportional to the developed force, and since the moving element 13 is balanced by the servo-system, this force is equal to the weight of the moving element 13. The variations of the average current are therefore indicative of the weight variations of the material contained in the chuting means 18, and can possibly be used for controlling the feeding system in order to keep a constant amount of material contained in the chuting means 18.

Obviously, in order to apply the present method the mistakes must be acceptable, in particular the friction of the guide whereon the equipment slides must not give any problem (since the system vibrates, there are lesser problems than with a still equipment suffering under the friction of the first detachment). Furthermore, the global weight can not be too high if compared to the variations to be measured.

The apparatus 1 is completed by a series of elements which are neither represented nor described. In particular, there is a capsule opening and closing system, a base (FND) moving system and a system for placing the base inside the measuring cell 22. Moreover, there are the usual protections to avoid the product dispersion in the environment and to guarantee a suitable protection to the operator and the necessary measuring accuracy.

Figure 2:
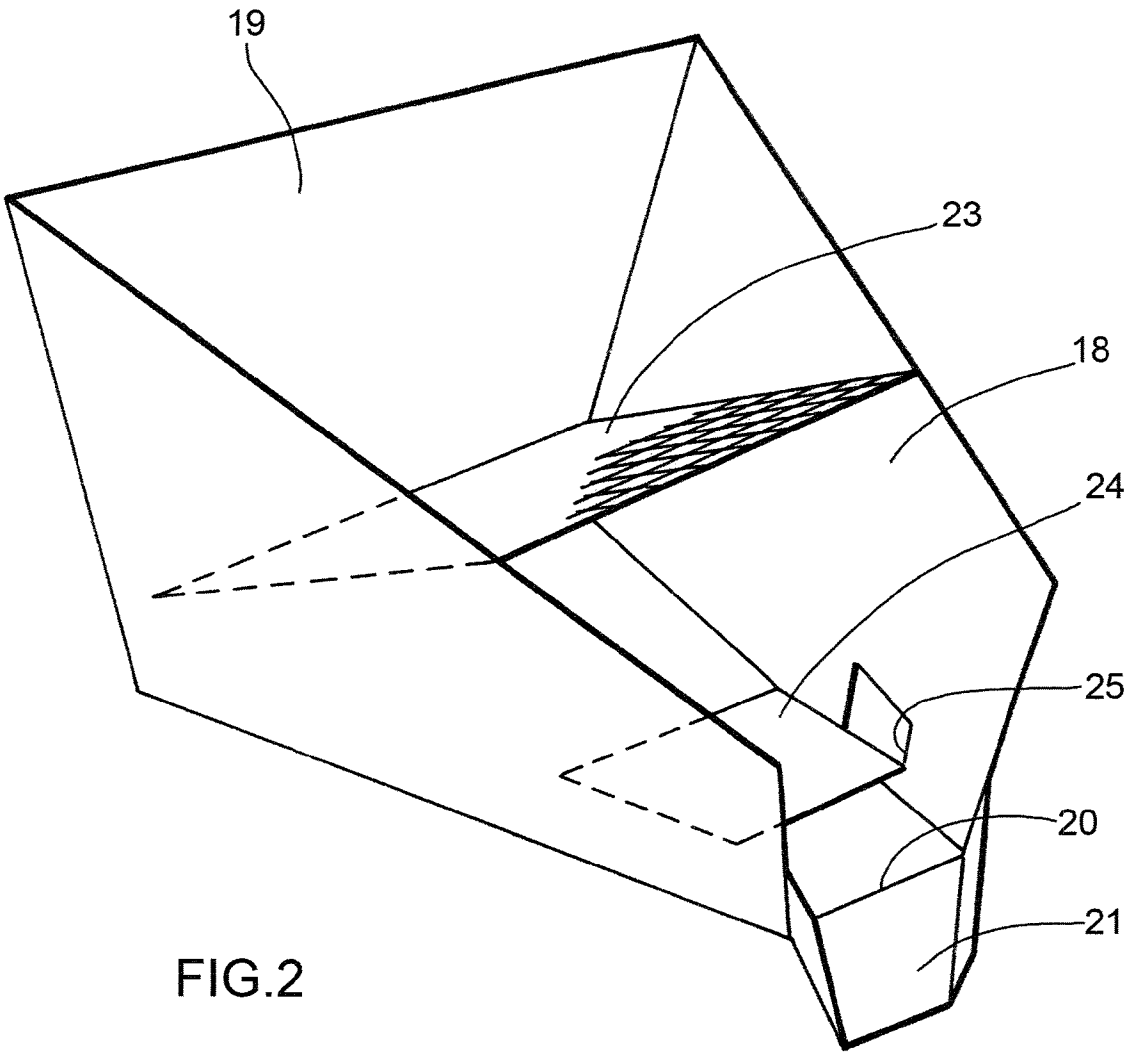
FIG. 2 shows an enlarged detail of the apparatus of FIG. 1.

The chuting means 18, shown in more detail in FIG. 2, are a light element, extremely simple, cheap and easily interchangeable; it is therefore possible to produce a series of them having different shapes (e.g. more or less broad, more or less elongated, with a front edge more or less wide, with a flat or slightly bent profile, etc.) for better treating the various kinds of products; furthermore, said chuting means 18 can be equipped with accessories described hereinafter.

As already stated, the chuting means 18 are fastened on a spherical articulated joint 17, which on its turn is fastened to a cursor 16; the spherical articulated joint 17 allows to adjust the inclination of the chuting means according to the three axes x, y, z.

The side inclination of the chuting means 18 (around the x axis, horizontal in FIG. 1) or transversal (around the z axis, vertical in FIG. 1) can be used to obtain particular results, for instance the detachment of possible granules and their removal through a waste route made by suitably shaping the chuting means 18 and/or by adding accessories.

The possibility to add different accessories to the chuting means 18 contributes to the flexibility of the system.

Therefore, it can be provided a proper "set" of accessories for better adapting to each material, thus foreseeing on the chuting means 18 suitable joints where these accessories can be fastened.

These accessories can be, for instance:

a net-sieve 23 (FIG. 2) for keeping/crushing possible clots;

a shaped diverting element 24 to convey the clots toward a suitable outlet 25 (FIG. 2);

a selecting baffle (not shown) for stopping and/or crushing the granules.

By the way, the selecting baffle is a vertical guillotine baffle, transversally disposed and not shown in the enclosed figures, blocking altogether the material with the exception of a horizontal slot between the sliding plane and the baffle, through which only dust and the smallest granules can pass, whereas the larger ones are stopped.

With regard to the controlling part, what adds to the flexibility is:

a) the characteristics of the pilot signal, in particular frequency, shape and symmetry, for controlling the progress, the possible detachment and the direction of the larger granules;

b) the filling rule, namely how the flow is progressively varied (decreased) till reaching the desired dosage;

c) the inclination of the stress axis (vertically represented in the figure) in order to provide the chuting means with a stress having both vertical and horizontal components by regulating the inclination.

Incidentally, it can be mentioned that it is also possible to use two different engines working on y and z axes for independently adjusting, if necessary, these two rules.

The adjustment of the spatial position of the chuting means can be manual or controlled by actuating means (not shown).

Thanks to the electronic measurement (free of inertia, if compared to mechanical scales) the filling time is extremely reduced.

The speediness of measurement allowed by the capacitive cell allows to use this system for completely automated high-speed machines wherein a plurality of metering devices parallelly fill several capsules. Contrarily, this could be hardly proposed by using mechanical scales, whose speed is much lower.

In this case (use on automatic machines) the proposed system can be very compact by combining the chuting means 18 with a suitable miniaturized actuator (for instance of piezoelectric type) instead of the linear engine 11, and in case omitting the transducer 12 ("open loop" working mode of the moving system).

In comparison with the conventional filling techniques the system of the present invention represents a substantial improvement in quality. In fact, not only the dosage is no longer volumetric but mass-based, but above all it follows the principle of real-time controlled dosage by measuring, instead of a "blind" dosage with a following measuring and possible rejection of the base (or of the capsule), should it not contain an acceptable amount of material.

Figure 3:
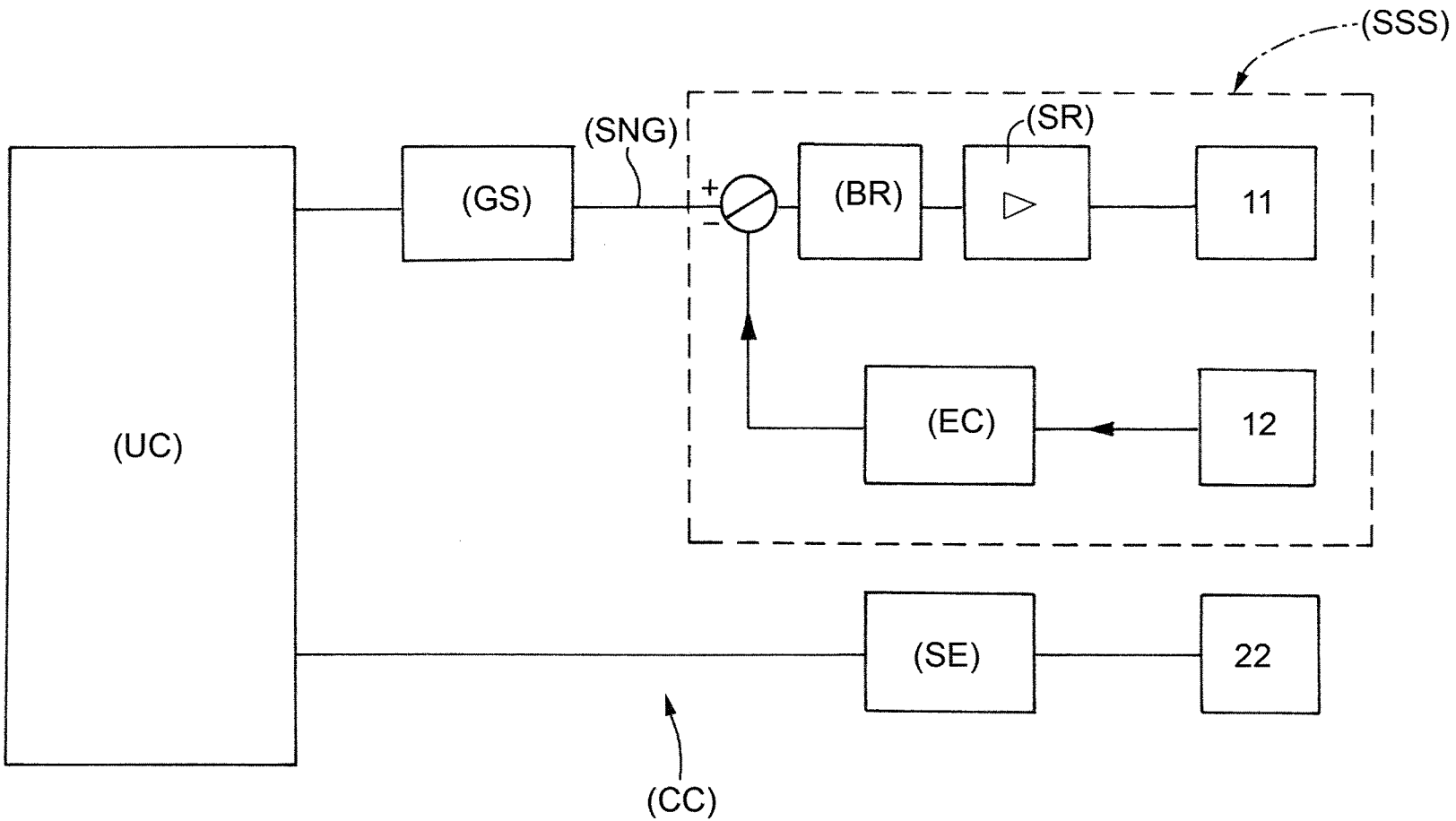
FIG. 3 schematically shows some components contained in an electronic control unit operating and controlling the apparatus shown in FIG. 1.

With a reference to FIG. 3, it can be noticed that the electronic control unit (CC) comprises a central unit (UC) which controls the dosing system by piloting the signal generator (GS) and measuring the released amount of product by means of the transducer (22) and of the relative conditioning electronics (SE).

The signal (SNG) coming out of the generator (GS) is sent to a position servo system (SSS) formed by the elements contained in the dotted rectangle of FIG. 3. This servo system (SSS) is constituted by a regulating block (BR) (for instance PID) followed by a power amplifier (SR) controlling the engine 11 according to the difference between the control signal (SNG) received at the entrance and the retroaction signal, received by the conditioning electronics (EC) from the position transducer 12. The regulating block (BR) can be analogical or digital.

In this way the engine 11 is able to impart to the moving element 13 movements faithfully following, within the system dynamics, the electric control signal (SNG) produced by the generator (GS) by order of the central unit (UC).

Therefore, by means of the capacitive mass transducer 22, the system is able to measure the mass of material inside the base (FND), continuously and with a negligible delay if compared to the progress of the dosing process. The result of the mass measurement is registered by the central unit (UC) which, by suitably varying the signal (SNG) directly determining the flow of material falling into the base (FND), can automatically regulate the process, thus following a predetermined progress of the flow according to the filling level till rapidly and accurately reaching the desired dosage.

The main advantage of the apparatus object of the present invention is represented by the fact that said apparatus overcomes the typical problems of solutions based on funnel-shaped containers ending with a sieve.

As previously stated, said problems are mainly due to the blockage of the sieve holes caused by the compacted material, or caused by the clots. Moreover, the diameter and the number of the sieve holes represent critical elements according to the characteristics of the material.

On the contrary, the apparatus object of the present invention shows a remarkable flexibility with regard to the kind of material and to the amount to be dosed. It also shows a high tolerance variations to the proposed system which turned out to be able to satisfactorily work even with remarkable variations of the material's characteristics (e.g. the moisture degree) without changing its configuration. Finally, a further advantageous characteristic is represented by the fact that the product is never "misused", which makes the apparatus suitable to be used with delicate materials.

The invention claimed is:

1. Apparatus for dosing powdery or granulated materials in capsules comprising an engine associated with means for controlling the position of a chute said engine imparting to said chute movements proportional to an electrical signal (SNG) controlled by an electronic control unit (CC);

the movements of said chute, together with an adjustment of the spatial position adopted by said chute, allowing for the precise dosage of said powdery or granular material into at least a container (FND);

wherein said chute is fastened on a spherical articulated joint, thus allowing for the adjustment of the inclination of the chute according to three axes (x, y, z);

wherein the axis defined by the engine and the position controlling means is selectively inclinable for imparting forces having different vertical and horizontal components.

2. Apparatus according to claim 1, wherein the apparatus is provided with a plurality of chuting means, having different shapes, in order to better treat various types of products.

3. Apparatus according to claim 2, wherein said chute is provided with a pilot element.

4. Apparatus according to claim 2, wherein said chute is provided with a net.

5. Apparatus according to claim 2, wherein said chute is provided with a shaped diverting element to convey the material toward an outlet.

6. Apparatus according to claim 2, wherein said chute is provided with a baffle for stopping and/or crushing the material.

7. Apparatus according to claim 1, wherein the engine is a linear "voice coil" or a piezoelectric engine.

8. Apparatus according to claim 1, wherein the position controlling means is of an LVDT type.

9. Apparatus according to claim 1, wherein said container (FND) is placed inside a measuring cell.

10. Apparatus (10) according to claim 9, wherein the measuring cell is of a capacitive type.

11. Apparatus according to claim 1, wherein the control unit comprises a central unit for piloting a signal generator (GS) and measuring product release by means of a transducer;

wherein the signal (SNG) from said generator (GS) is sent to a servo system (SSS) comprising a regulating block (BR) followed by a power amplifier (SR) for controlling the engine according to the signal of said position controlling means.

12. Apparatus according to claim 1, wherein the electronic control unit (CC) comprises a central unit (UC) for generating a signal in order to control dosing.

13. Apparatus according to claim 1, wherein capacity is controlled according to the dosage amount, thereby allowing for a pre-determined dosage profile to be followed which foresees an initial quick release and a final slow release in order to obtain a more precise dosage.

* * * * *